US006125824A

United States Patent [19]

Klare et al.

[11] Patent Number: 6,125,824

[45] Date of Patent: Oct. 3, 2000

[54] METHOD OF CONTROLLING THE INJECTION PROCESS IN A HIGH-SPEED 2-STROKE FUEL INJECTION INTERNAL COMBUSTION ENGINE

[75] Inventors: Hartmut Klare, Benshausen; Andreas Singer, Fraureuth, both of Germany

[73] Assignee: Dolmar GmbH, Hamburg, Germany

[21] Appl. No.: 09/214,892

[22] PCT Filed: Jul. 17, 1997

[86] PCT No.: PCT/EP97/03819

§ 371 Date: Jul. 20, 1999

§ 102(e) Date: Jul. 20, 1999

[87] PCT Pub. No.: WO98/03785

PCT Pub. Date: Jan. 29, 1998

[30] Foreign Application Priority Data

Jul. 17, 1996 [DE] Germany ..... 196 28 739

[51] Int. Cl.[7] ..... F02M 51/00

[52] U.S. Cl. ..... 123/476; 123/478; 123/73 C

[58] Field of Search ..... 123/476, 73 C, 123/305, 478

[56] References Cited

U.S. PATENT DOCUMENTS

| | | | |
|---|---|---|---|
| 5,325,835 | 7/1994 | Kimata et al. . | |
| 5,329,907 | 7/1994 | Nonaka . | |
| 5,392,753 | 2/1995 | Burson et al. . | |
| 5,544,636 | 8/1996 | Geiger et al. | 123/478 |
| 5,634,449 | 6/1997 | Matsumoto et al. | 123/478 |
| 5,806,488 | 9/1998 | Imberg | 123/478 |
| 5,832,901 | 11/1998 | Yoshida et al. | 123/478 |

FOREIGN PATENT DOCUMENTS

| | | | |
|---|---|---|---|
| 0 434 111 | 6/1991 | European Pat. Off. . | |
| 0 583 495 | 2/1994 | European Pat. Off. . | |
| 0 695 865 | 2/1996 | European Pat. Off. . | |
| 0 066 758 A2 | 12/1982 | Germany | F02D 5/00 |
| 39 26 322 A1 | 2/1990 | Germany | F02D 41/34 |
| 39 28 405 A1 | 3/1990 | Germany | F02D 41/34 |
| 41 09 538 A1 | 1/1992 | Germany | F02D 13/02 |
| 40 05 797 C2 | 2/1992 | Germany | F02D 41/30 |
| 40 17 432 C2 | 8/1993 | Germany | F02D 41/40 |
| 41 19 262 C2 | 9/1993 | Germany | F02D 41/22 |

OTHER PUBLICATIONS

16th ISATA, Proceedings vol. 1, *16th International Symposium on Automotive Technology & Automation.*

*Primary Examiner*—John Kwon

*Attorney, Agent, or Firm*—McCormick, Paulding & HuberLLP

[57] ABSTRACT

Disclosed is a method for controlling the injection process in a high-speed two stroke internal combustion engine (11). The method includes providing a trigger signal fixedly related to the rotational angle of the crankshaft per revolution of the injection control, providing a speed dependent A.C. voltage, whose period duration amounts to a fraction (L/n) of the time per revolution (rotation time) of the internal combustion engine (11), and controlling the injection process responsive to the trigger signal and the A.C. voltage. Accordingly, the invention provides a simple electronic injection control with optimal, accurately computable injection parameters for all speeds.

7 Claims, 3 Drawing Sheets

METHOD OF CONTROLLING THE INJECTION PROCESS IN A HIGH-SPEED 2-STROKE FUEL INJECTION INTERNAL COMBUSTION ENGINE

FIELD OF THE INVENTION

The invention relates to a method for controlling the injection process in a high-speed two-stroke internal combustion engine with fuel injection, which two-stroke internal combustion engine possesses first means for the generation of a trigger signal that is in fixed relationship to the rotational angle of the crankshaft per revolution for the injection control as well as second means for the generation of a speed-dependent A.C. voltage, whose period duration is a fraction (L/n) of the time per revolution (rotation time) of the two-stroke internal combustion engine.

BACKGROUND OF THE INVENTION

It is known from the EP-A1-0 688 951 to provide an injection control for small, compact batteryless four-stroke engines, in which an electromagnetic injection valve is operated by means of voltage pulses, which are induced by a co-rotating permanent magnet mounted on a flywheel in a coil assembly rigidly mounted in the proximity of the flywheel. While the injection start is unchangeably determined by the position of the coil assembly, the injection duration is limited by a timing control circuit according to a computed period of time by an interruption of the injection valve circuit. The problems which arise when such an injection valve circuit is interrupted are described in the EP-B1-0 543 826. Whereas four-stroke engines generally possess a relatively constant engine running over the entire speed and load range, two-stroke enginesmanifest significant differences between the speed ranges "idling" and "operative range". In the idle running (low speeds of some 100 r.p.m.), a considerably rough running exists which always calls for an accurate injection. If, starting out from a certain trigger signal, a computation of the injection start is performed, the same has to take place within the immediate proximity of the trigger signal since otherwise serious errors with regard to the desired injection start may occur. As already mentioned, these depend essentially upon the degree of regularity of the running of the engine and may differ considerably from revolution to revolution so that the running of the engine becomes uncontrollable. That is why also the injection has to take place in the immediate proximity of the trigger point or trigger signal.

As is depicted in the FIG. 1 in an angular diagram of the engine crankshaft (KW) in relation to the upper compression point (OT), for lower speeds the injection starts (ESB), in dependence upon the respective engine configuration, are located in a first (shaded) range (ESB1) at between 180 and 240° KW (angle W4 and W3) before the upper compression point (OT) of the internal combustion engine. At higher speeds (several 1000 r.p.m.), other injection starts, depending on the respective load states, are necessary. Usualyl, a displacement of the injection start in the direction "Early" into a second (shaded) range (ESB2) is necessary, which is located between 270 and 350° KG (angle W2 and W1) before the upper compressions point (OT).

For low speeds (e.g. when idling), according to the foregoing explanations it is both expedient and advantageous to place the trigger point at which the trigger signal is generated, close to the beginning of the first range (ESB1), thus e.g. at the point identified with (TP) in FIG. 1. In this way merely a short angular distance exists between (TP) and the start of the injection area (W3). When the injection start, at increasing speeds, is now displaced forwardly from the range (ESB1) into the range (ESB2), the rtigger point (TP) should actually also be displaced accordingly. A (quasi) displacement of the trigger point does expediently take place in that the computation of the injection start is performed for the next revolution (long arrow from TP via the angles W5 and W6 of the ignition area ZB to W1 in FIG. 1). On account of the requisite computation time of the period necessary for controlling the opening time of the injection valve, it may, in dependence upon the required injection start, happen that the trigger signal being used for the idling range (e.g. of a Hall transmitter) cannot be evaluated. Because of this, the injection for the next revolution would not be possible, or only strongly subject to errors.

SUMMARY OF THE INVENTION

The technical problem of the invention is now to state a method for the injection control of a high-speed two-stroke engine which, without modifications to the internal combustion engine itself, overcomes these disadvantages and, for each revolution of the internal combustion engine, in dependednce upon load and speed, guarantees an optimal injection start in conjunction with the requisite injection duration.

In a method of the kind stated in the beginning the technical problem is resolved in that, for the control of the injection process, besides the trigger signal, the generated A.C. voltage is additionally called upon. Due to the A.C. voltage with its periodicity being drawn upon, it is possible without any modification to the internal combustion engine to make additional reference points available during the revolutions, to which the ignition control is able to make reference.

A first preferred ambodiment of the metod according to the invention is distinguished in that, from the individual periods of the generated A.C. voltage, associated values of the angle of rotation are derived, which rotational angle values, in conjunction with the trigger signal, can be drawn upon for the injection control. It is possible hereby to generate almost equidistant angular marks, which permit an optimal control of the injection process at different and fluctuating speeds.

A further prefered embodiment of the method according to the invention is characterized in that, for the correct allocation of the rotational angle values to the periods of the A.C. voltage at time-wise constant fluctuations in the length of the individual period durations caused by e.g. manufacturing tolerances or the like, the individual period durations are measured, from the ratio of the measured period durations to the theoretical period durations which, in each case, constitute a fraction (L/n) of the revolution time, a correction factor for each period duration is determined in that, to each period duration, while employing the associated correction factor, a relative corrected rotational angle value is allocated and in that, in reference to the rtigger signal in fixed relation to the rotational angle to the crankshaft, the relative corrected rotational angle values are converted into absolute corrected rotational angle values, which are used for the injection control. By means of the determination of the correction factors it is possible to correct irregularities caused in the manufacture without modifications to the internal combustion engine.

When, according to another preferred embodiment, as a compensation for time-wise variable fluctuations in the length of the period durations caused particularly by fluctuations in the speed and/or phase shifts in the A.C. voltage, the correction factors are repeatedly and successively determined and stored and, from the stored correction values, statistically averaged corection values are formed and, for the allocation of the relative corrected rotational angle values, are employed for the period durations, it being also possible to very largely eliminate the influence of brief changes on the determination of the correction values.

Further embodiments result from the dependent claims.

BRIEF DESCRIPTION OF THE DRAWINGS

In the following it is intended to explain the invention in greater detail with the aid of embodiments in connection with the drawings.

Thus

DETAILED DESCRIPTION OF THE PREFERRED EMBODIMENT

Figure 1:
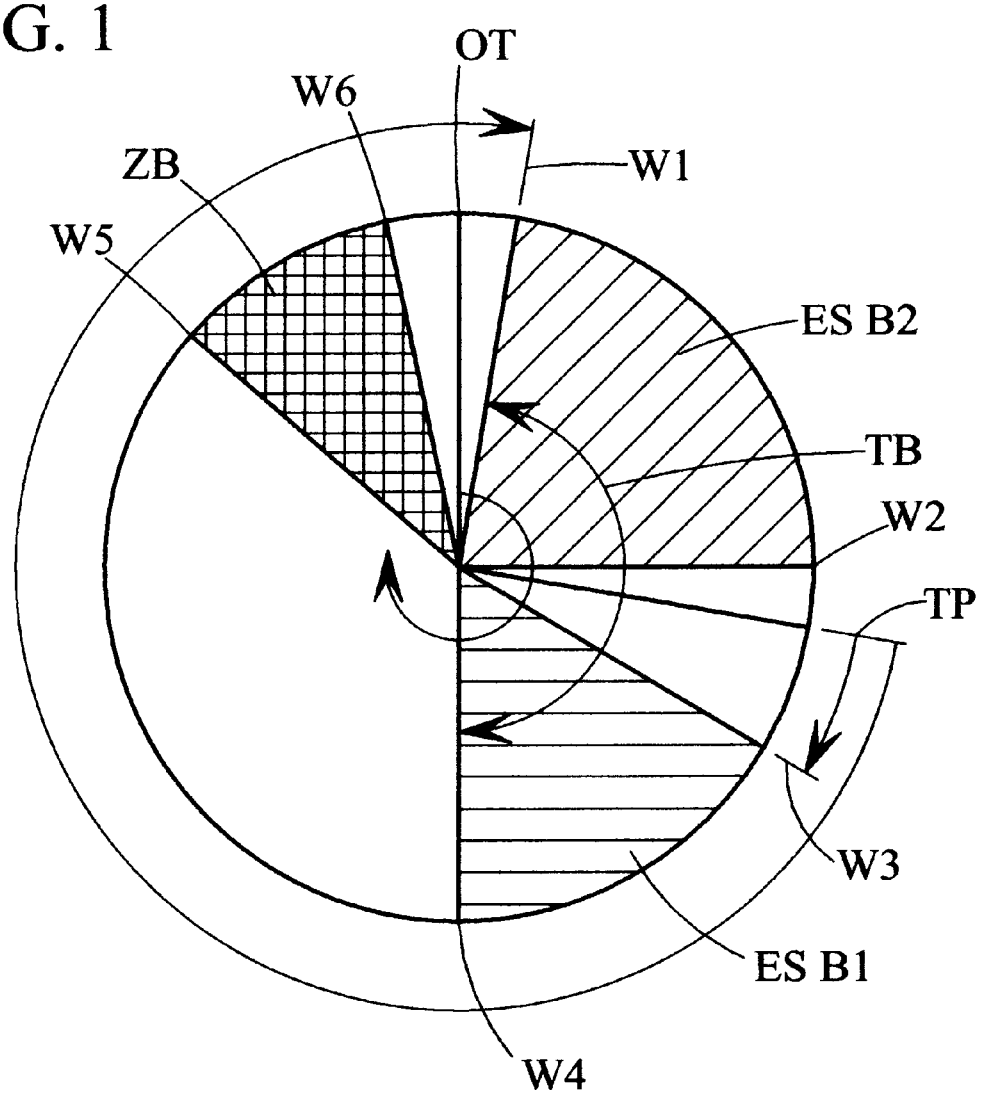
FIG. 1 shows an angle diagram related to the crankshaft rotation with the control angle for a conventional injection control with a trigger point.
Figure 2:
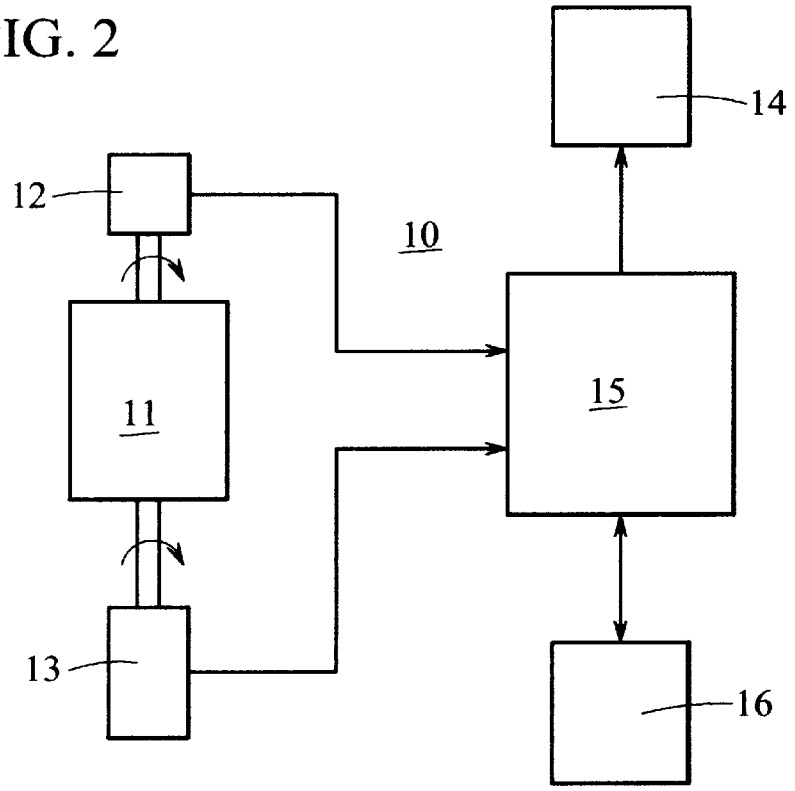
FIG. 2 shows in a block diagram an exemplary device for the performance of the method according to the invention.

In FIG. 2, a block diagram, an exemplary device for performing the method according to the invention is reproduced. The control device 10 is allocated to a high-speed two-stroke internal combustion engine 11, on which, coupled to the speed, an ignition 12 and a generator 13 for the generation of a periodic A.C. voltage are disposed. The ignition 12 comprises by way of example a rotating ignition magnet which generates a suitable ignition signal in a stationary coil, which is available to the injection control in the form of a trigger signal fixedly related to the rotational angle of the crankshaft. The periodic A.C. voltage from the generator 13 and the trigger signal from the ignition 12 are transmitted to suitable inputs of a microcontroller 15, which interacts with a non-volatile memory for depositing computed correction values and which controls, with one output, an injection valve 14 for the two-stroke internal combustion engine 11.

Figure 3:
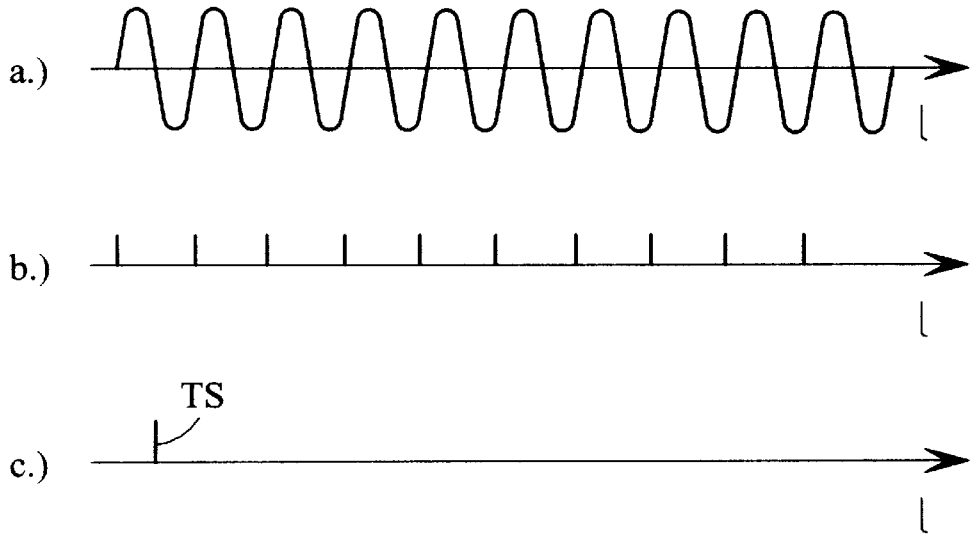
FIGS. 3(*a*)–3(*c*) show several time diagrams for explaining the mode of procedure when determining the rotational angle values according to the invention and FIG. 4 shows a program flow chart for the computation of the correction values in the method according to the invention.

The basis of the method according to the invention is now the making available of the fixed periodic trigger signal (TS), which—as already mentioned—can be generated in conjunction with the already existing ignition 12 and which is generated in the form of a single pulse per revolution (see FIG. 3*c*). Furthermore, for the solution according to the invention, the generator 13, e.g. a gnerator flanged on to the engine 11, is employed, which, per revolution of 360°, emits a certain number n of sine waves (in the further explanation n-10 is assumed; see FIG. 3*a*) . From these sine waves, pulses can be derived (see FIG. 3*b*), which (for n-10) possess an angular distance of 36°. The generator pulses are supplied to the microcontrollert 15 which, in addition, receives the fixed trigger pulse (TS) from the ignition. From these pulses, the microcontroller 15 not only realizes the mathematical computation of the injection values (injection start, injection duration), but moreover possesses the capability of carrying out an angular correction of the 36° pulses. This correction is necessary since the pulse distances or period durations, in consequence of manufacturing tolerances and phase shifts by electric loads at the generator, are subject to errors. It has to be stated in this connection that the computer, for the determination of the injection start or the injection duration, has to fall back on further parameters such as temperature, load signal, etc., so that these values have to be understood as result of an appropriate computation.

Figure 4:
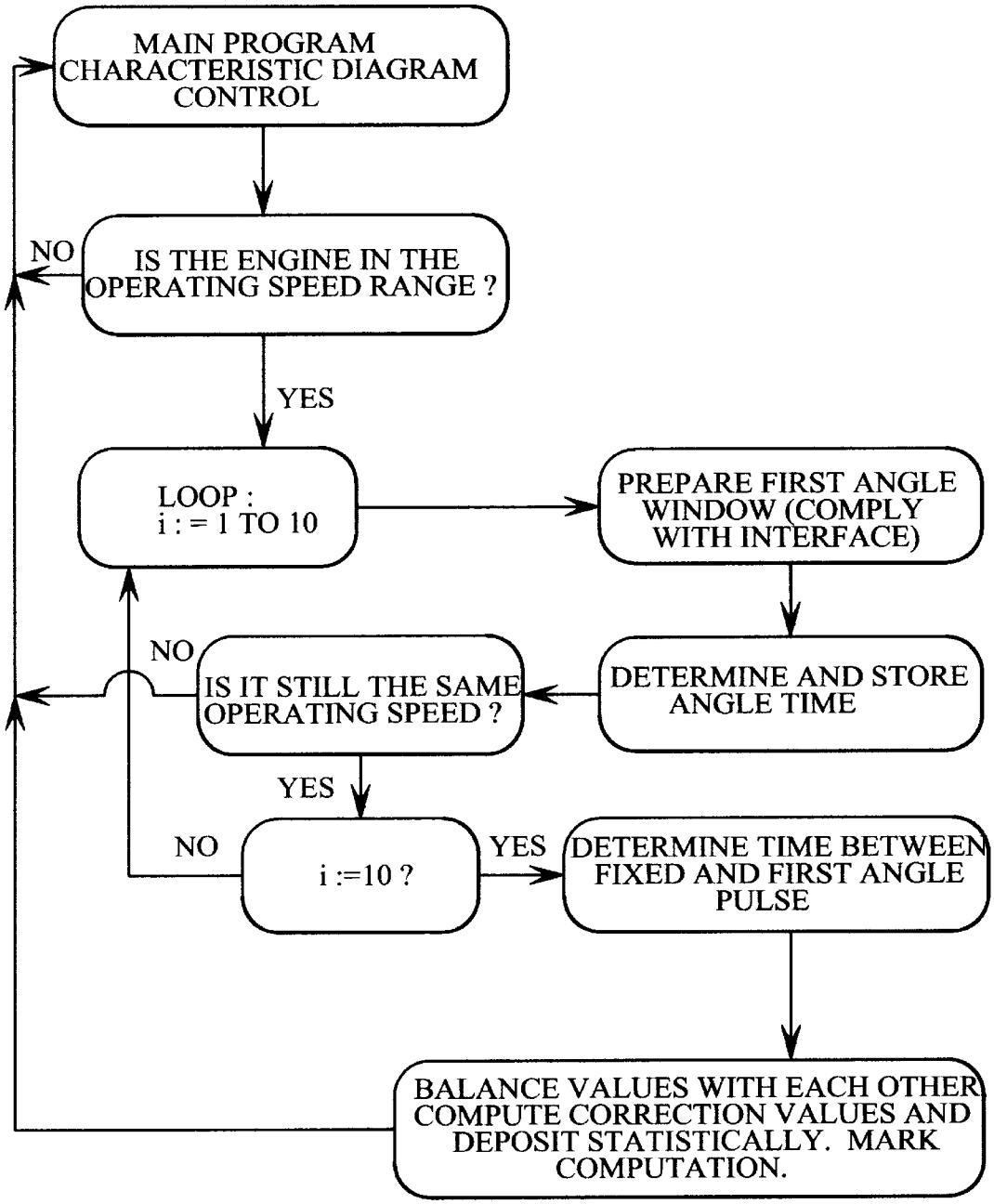

As a mathematical basis of the correction of angular errors, the fixed trigger pulse (TS)(FIG. 3*c*) is employed which serves as reference value in this system. When the microcontroller 15 recognizes that the internal combustion engine 11 is in the operating speed range, in which the constancy degree of the internal combustion engine is greatest, the main program, which computes the injection values for the current revolutions, is left for a brief momermnt, as is reproduced in the self-explanatory program flow chart of the FIG. 4.

Speed measurements begin in all 36° windows. In the process, the synchronism of the internal combustion engine is continually controilled. In the angle windows, the time windows (period durations of the generator pulses) are measured. If the synchronism errors of the internal combustion engine have been recognized as being sufficiently small, then the time window measurement (period duration measurement) is significant, i.e. the measurement values are acceptable.

The summing up of the time in the time windows results in the true time of a speed. Consequently, the subwindows have to amount to precisely 36°, thus 10% of the total rotational time. Each window is now provided here with a correction factor, and the correction factors, in the present example 10 in their number, are entered into the non-volatile memory 16. In addition, it is noted down that a correction measurement has been performed.

The microcontroller 15 now returns to the main program where, in a predetermined interval, it computes this routine afresh. The new correction values are in each case statistically processed with the already in advance computed and stored correction factors in such a way that, in the end n (here: 10) statistic mean values for the divergence of the 36° windows from the symmetry exist and this in such a way that, with an increasing running time 10, these correction factors converge on to the real value. By means of this mode of procedure the microcontroller 15 is in a position to react to manufacturing tolerances of the generator 13 and to generate certain correction factors which inform the same of how gig the individual angular sections fixed by the periodic pulses are in reality.

The arithmetical allocation of the angular windows to the upper compression point (OT) or to the fixed trigger pulse (TS) is based upon the creation of a time window between the trigger pulse (TS) and the following pulse from the generator 13 in time intervals that intermit predetermined individual revolutions. On the strength of the computed speed, the microcontroller 15 computes the time difference between these two consecutive pulses and thus computed the absolute correction related to the upper compression point (OT).

For the computation of the theoretical values, the microcontroller 15 has access to already preset determinations from the engine characteristic diagram, which are deposited in a characteristic diagram control. The microcontroller 15 adapts the deposited characteristic diagram values to their computed angular values and thus controls the injection valve 14 in a self-correcting fashion.

Altogether, with the invention, an electronic possibility results which, in a simple way without a fundamental technical revision of the construction of two-stroke internal combustion engines, supplies optimal and accurately computable injection parameters.

LIST OF REFERENCE NUMBERS

| | |
|---|---|
| Control device | 10 |
| two-stroke internal combustion engine (high-speed) | 11 |
| ignition (first means) | 12 |
| generator (second means) | 13 |
| injection valve | 14 |
| microcontroller | 15 |
| memory (non-volatile | 16 |
| injection start range | ESB1, ESB2 |
| upper compression point | OT |
| trigger range | TB |
| trigger point | TP |
| trigger signal (trigger pulse) | TS |
| ignition range | ZB |
| angles | W1–W6. |

What is claimed is:

1. Method for controlling the injection process in a high-speed two-stroke internal combustion engine (11) with fuel injection, comprising, providing a trigger signal (TS) in fixed relation to the rotational angle of the crankshaft per revolution for the injection control, providing a speed-dependent A.C. voltage, whose period duration is a fraction (L/n) of the time per revolution (rotation time) of the two-stroke internal combustion engine (11), wherein providing the speed-dependent A.C. voltage includes providing a heating generator (13), which is mounted on the two-stroke internal combustion engine (11) and is driven by the same and wherein, from the individual periods of the A.C. voltage, associated values of the rotational angle are derived, and wherein the injection process is controlled responsive to the rotational angle values.

2. Method according to claim 1, wherein fluctuations in the length of the individual period durations can occur, and, for the correct allocation of the rotational angle values to the periods of the A.C. voltage, the individual period durations are measured, from the ratio of the measured period durations to the theoretical period durations, which in each case amount to a fraction (L/n) of the revolution time, a correction factor for each period duration is determined, and to each period duration, while employing the associated correction factor, a relative corrected rotational angle value is allocated, and, while reference is made to the trigger signal (TS) fixedly related to the rotational angle of the crankshaft, the relative corrected rotational angle values are converted into absolute corrected rotational values which are used for the injection control.

3. Method according to claim 2, wherein for the compensation of time-wise variable fluctuations in the length of the period durations caused by at least one of speed fluctuations and phase shifts in the A.C. voltage, the correction factors are repeatedly and consecutively determined and stored and statistically averaged correction values are formed from the stored correction values and used for the allocation of the relative corrected rotational values for the period durations.

4. Method according to claim 2, wherein the measurement of the individual period durations within the operating speed range of the two-stroke internal combustion engine (11) is effected in that, during the measurements, the synchronism of the two-stroke internal combustion engine (11) is continually monitored and the measured values are evaluated only when the synchronism error during the measurement is below a predetermined value.

5. Method according to claim 1, wherein controlling the injection process includes providing a microcontroller (15) which, according to the trigger signal (TS) and the A.C. voltage, reads out pertinent characteristic diagram values from a characteristic diagram control and uses the same for the control of an injection valve (14).

6. Method according to claim 1, wherein providing the trigger signal includes providing a signal from the ignition (12) of the two-stroke internal combustion engine (11).

7. Method according to any of claims 1 to 6, characterized in that the first means comprise the ignition (12) of the two-stroke internal combustion engine (11) and in that the second means comprise a heat generator (13) which is mounted on the two-stroke internal combustion engine (11) and is driven by the same.

* * * * *